United States Patent [19]

Atherton

[11] 4,305,170

[45] Dec. 15, 1981

[54] DINGHY

[76] Inventor: Thomas G. F. Atherton, Arragon House, Santon, Isle of Man

[21] Appl. No.: 116,952

[22] Filed: Jan. 30, 1980

[30] Foreign Application Priority Data

Feb. 1, 1979 [GB] United Kingdom ..... 3623/79

[51] Int. Cl.[3] ..... B63B 7/08

[52] U.S. Cl. ..... 9/1.3; 9/2 A

[58] Field of Search ..... 9/1.3, 2 A, 11 A, 310 F, 9/310 G, 347

[56] References Cited

U.S. PATENT DOCUMENTS

| | | | |
|---|---|---|---|
| 1,722,523 | 7/1929 | Hunter | 9/1.3 X |
| 2,791,981 | 5/1957 | Lane | 9/1.3 X |
| 3,871,042 | 3/1975 | Farmer | 9/1.3 |

FOREIGN PATENT DOCUMENTS

| | | | |
|---|---|---|---|
| 2751494 | 5/1979 | Fed. Rep. of Germany | 9/1.3 |

*Primary Examiner*—Ralph J. Hill

*Attorney, Agent, or Firm*—Ross, Ross & Flavin

[57] ABSTRACT

To simplify the manipulation of a dinghy between water and a storage location above high water mark, the dinghy is constructed so as to be circular when viewed in plan and is provided with pivotal means, such as a frusto-conical buoyant body having a bore, for receiving a handle whereby the dinghy can be rolled on its outer peripheral edge after the manner of a wheel, while being pushed, pulled and/or controlled by means of the handle. The handle may be in the form of a pole inserted by one end into the body and retained therein by rollers on radial stubs engaging with the undersurface of the dinghy floor. Other means, such as a peg loaded by a leaf spring engaging into a circumferential groove around the pole, may be provided for retaining the pole. An alternative form of handle arrangement may be in the form of a yoke providing arms which extend along each side of the dinghy and have respective pivot pegs engaging into the socket means from opposite ends thereof. Such an arrangement may be adapted for coupling to the towing hitch of a vehicle.

8 Claims, 7 Drawing Figures

DINGHY

BACKGROUND OF THE INVENTION

This invention concerns dinghies, which term includes, of course, small boats both for utilitarian purposes as well as for pleasure use.

A major difficulty with the use of a dinghy for example for disembarking from and obtaining access to a boat or ship riding at anchor, or for pleasure or other purposes, lies in the handling of the dinghy, particularly whilst on land. For example, an owner or user of a launch which may be generally anchored just off shore when not in use may need provision for a dinghy to remain at or to be stored at some location above high water mark, and in order to make use of it, it will be necessary to manoeuvre the same down to the water. If, for example, he is proposing to go out on a long trip, there is the additional problem of transporting not just the dinghy, but also of provisions, stores and equipment, as well as any accessories, such as oars, baling equipment, inflation pump, and possibly an outboard engine and fuel, and so on which may be necessary for the use of the dinghy. On the western coasts of the British Isles, the average difference in height between low and high tides is approximately twenty feet (i.e. in excess of six meters) and this can represent a considerable distance over the shore, often amounting to some hundreds of meters and in the case, for example, of shallow regions such as at Southport on the Lancashire coast, as much as a kilometer or two. It is therefore often necessary for a dinghy user, upon coming in to shore, to manhandle the dinghy, sometimes over a substantial distance, to get it above the high water mark, and then subsequently when he requires to use it again he has to get the craft back down to the water, together perhaps with many of the appurtenances already referred to.

Even a relatively-small conventional dinghy may require two people to move it about on land, under normal practical circumstances. Of course, a light craft may be manoeuvred with varying degrees of difficulty by one person, especially if it is mounted on a wheeled trolley or trailer, but even this does not provide an ideal solution to the problem, because the dinghy itself has to be unloaded from or loaded onto the trolley or trailer, as may be necessary, and as an additional item may have to be moved about independently of the dinghy. Thus, for instance, where a trolley or trailer is used to move a dinghy from above the high water mark down to the water's edge, this trolley or trailer may have to be taken back to its starting position above the high water mark, during which time the dinghy has to be left in such a place as to ensure that it is still there upon the user's return after disposing of the trolley or trailer. Moreover, if the disposal of the trolley or trailer should take any significant time, the user may find, upon his return either that the dinghy has been beached due to ebb of the tide, in which case it has to be manhandled once again to get it into the water, or that the tide has come in and the dinghy is floating away from the water's edge, in which case the user may not be able to avoid getting wet when boarding the dinghy.

Because of these difficulties in handling dinghies on shore, slipways or sharply shelving beaches are often regarded as being the most suitable places for launching dinghies, but of course these may not be conveniently available. The ideal solution, of course, is to make use of a marina but they are not universally available and even where they are their use may be expensive.

OBJECT OF THE INVENTION

An object of the present invention is to provide a construction of dinghy whereby many of the above-discussed difficulties can be substantially obviated or avoided.

SUMMARY OF THE INVENTION

With this object in view, the present invention provides a dinghy which is of substantially circular configuration when viewed in plan, and is provided with pivotal means in the region of the centre of the circle so that it can be rolled on its edge after the manner of a wheel, the pivotal means enabling the dinghy to be pushed, pulled and/or controlled whilst being so rolled.

The dinghy may be of a rigid construction, or it may be of semi-rigid construction, or it may be inflatable. In the latter instance, the structure of the dinghy conveniently comprises a tubular annulus of tough reinforced rubber, reinforced plastics, or the like material formed with a floor.

In one way of carrying the invention into effect, the pivotal means comprises socket means disposed substantially centrally of the floor of the dinghy and accommodating a handle which may be removable or may be non-removable.

This handle may simply be in the form of a pole detachably engageable by one end into the socket means.

A retainer for the handle, when it is removable, may be in the form of a spring-loaded member engageable into a groove around the handle.

Alternatively the handle may, for instance, extend through the socket means, being provided on said one end with lateral roller means preventing withdrawal thereof from one side of the dinghy.

In another form, the handle may comprise a yoke providing a side-by-side pair of arms, these having respective pivot members, which pivot members engage into the socket means from opposite sides of the floor of the dinghy.

For stabilising the dinghy whilst it is being rolled, there may be a stabilising hoop, generally of inverted-U configuration, supporting rollers at each side of the dinghy.

The handle, yoke or the like of the pivotal means of the arrangement of the invention may, if desired, be adapted for hitching to a vehicle so that the dinghy can, if desired, be towed behind the vehicle.

In the latter instance, a flexible rubbing strake or strakes around the dinghy may serve also as a tread surface for contacting the ground during such towing.

The socket means may advantageously comprise a flat-topped body which may also serve as a seat in the dinghy. This body may be of light and buoyant material.

BRIEF DESCRIPTION OF THE DRAWINGS

The invention will be described further, by way of example, with reference to and accompanying diagrammatic drawings, in which.

DESCRIPTION OF THE PREFERRED EMBODIMENTS

Figure 1:
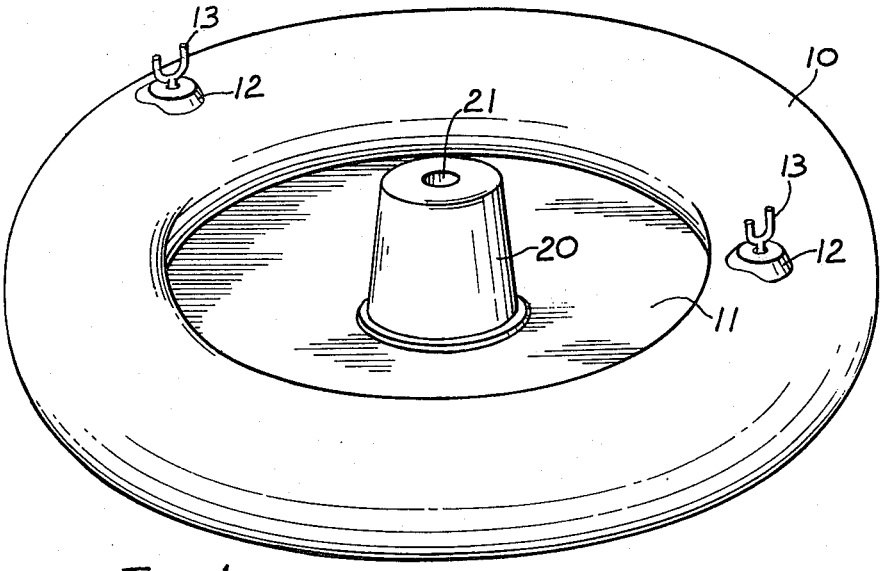
FIG. 1 is a perspective view from above illustrating a first embodiment of the dinghy of the invention, but with its handle omitted.
Figure 2:
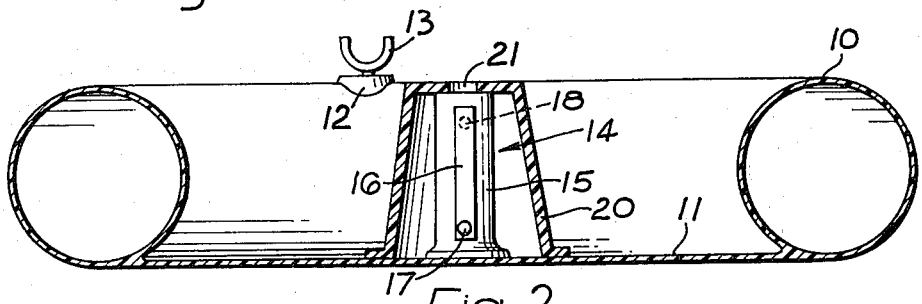
FIG. 2 is a sectional elevation of the dinghy of FIG. 1.

In the various figures of the drawings, similar reference numerals have been allocated to similar parts.

Referring firstly to FIGS. 1 to 4 of the drawings, a first embodiment of the dinghy of the invention is of inflatable form and comprises a tubular annulus 10 to which a floor 11 is bonded. As is known in relation to inflatable dinghies, the annulus 10 may be divided by partitions (not shown) into a plurality of separate compartments so that in the event of a puncture, only one of the compartments will deflate and the dinghy will remain buoyant. Naturally, each compartment is provided with a respective inflation valve (not shown).

Formed in the annulus 10 are locators 12 for rowlocks 13 which later may, if desired, be removable.

Centrally disposed of the floor 11 of the dinghy is a socket arrangement which is indicated generally by the reference numeral 14 and comprises a tubular socket member 15 secured by its bottom end to the floor 11 and open at its upper end. A flat leaf spring 16 is secured by one end, by a rivet or the like 17, to the socket member 15 so as to extend therealong and carries a peg 18 which has a rounded free end and projects through an opening 19 in the wall of the socket member 15.

A body in the form of a frusto-conical shroud 20, having a hole 21 in its top, is provided over the socket member 15 and may serve as a seat for an occupant of the dinghy.

Figure 3:
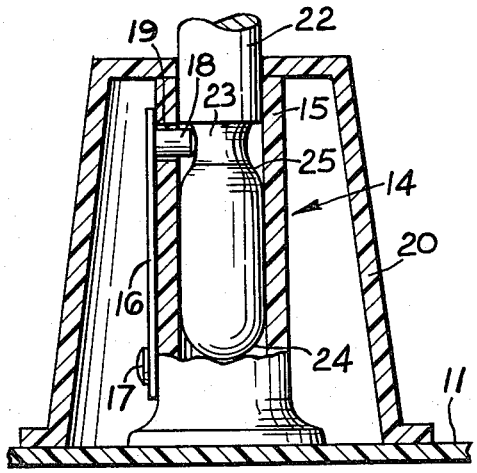
FIG. 3 is an enlarged sectional detail illustrating how the handle fits in place and is retained, in the dinghy of FIGS. 1 and 2.
Figure 4:
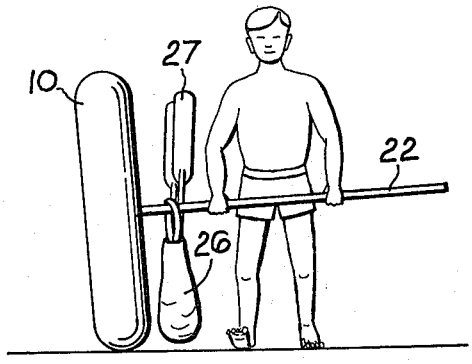
FIG. 4 is a diagrammatic elevation, to a reduced scale, illustrating how the dinghy of FIGS. 1 to 3 can be moved about by rolling.

Complementary to the socket arrangement is a handle 22, the form of which may be appreciated generally from FIG. 4 and which is in the form of a pole having, adjacent one end, a circumferential groove 23 which can be seen in FIG. 3. As shown in FIG. 3, the said one end of the handle 22 is rounded at 24 so that upon insertion into the socket member 15 it deflects the peg 18 against the action of its spring 16, until the peg 18 registers with and engages into the groove 23. Thus, the peg 18 serves to retain the handle 22 against unintentional withdrawal from the socket member 15; however, the groove 23 is rounded at 25, so that the peg 18 will be deflected to permit withdrawal of the handle 22 upon application of substantial withdrawing force thereto.

As will readily be appreciated from FIG. 4, the socket arrangement 14 in combination with the handle 22 constitutes pivotal means which enables the dinghy to be pushed, pulled and/or controlled whilst being rolled on its edge after the manner of a wheel. Let it be assumed the dinghy to be initially lying down flat in a place of storage. When it is required to be used, the user inserts the handle 22 into the socket member 15, wherein it is retained by the spring-loaded peg 18, and he can then very easily swing the dinghy onto its edge by means of the handle 22. The user can then, if desired, arrange on the handle 22, at a location close to the dinghy, a knapsack, bag or other receptacle 26 containing any supplementary materials, such as provisions, oars 27, accessories or the like, so that the moment thereof on the handle, about the fulcrum provided by the point of contact of the dinghy with the ground, is relatively low. The user can then roll the dinghy like a wheel, whilst gripping the handle 22 which is of course used to steer and control the movement of the dinghy as it is rolled from above high water mark down to the water or vice versa, the position of the receptacle 26 being such that it does not constitute a heavy load on the user's hands. If desired, the handle 22 may be designed so as to be one of the oars of the dinghy or so as to act as a mast for a sail (not shown).

Figure 6:
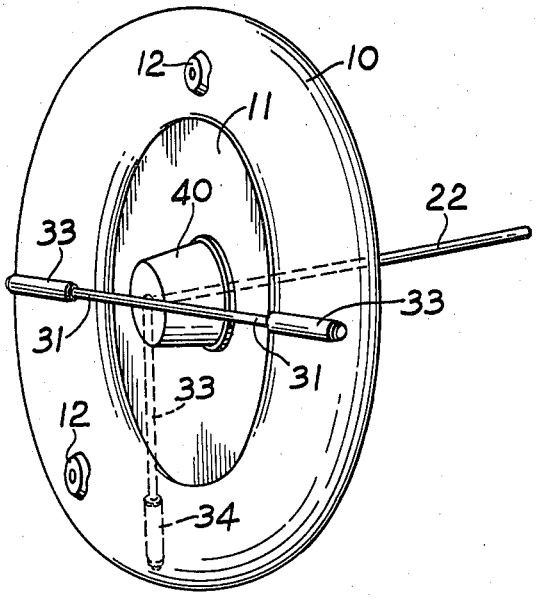
FIG. 6 is a perspective view, to a scale reduced compared with FIG. 5, showing the underside of the dinghy of FIG. 5, and also showing a possible modification.
Figure 5:
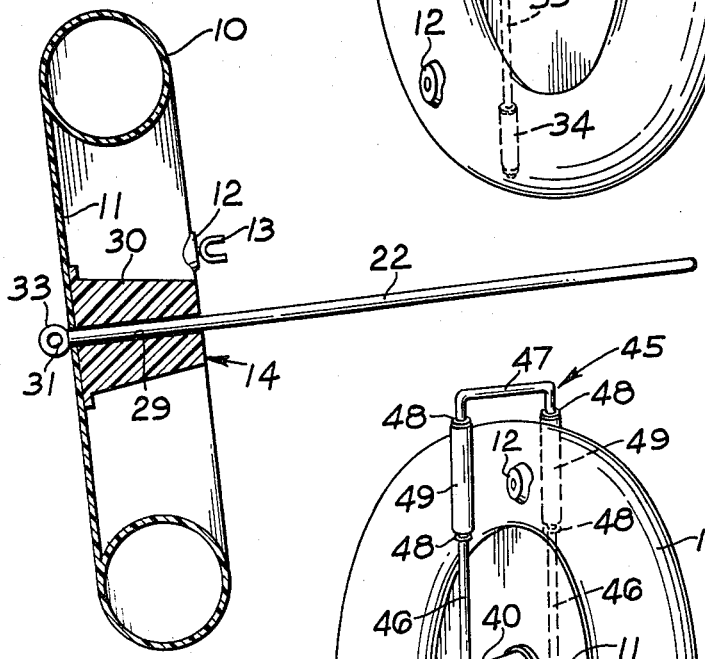
FIG. 5 is a sectional elevation, to a scale similar to that of FIGS. 1 and 2, illustrating a second embodiment of the dinghy of the invention, this being shown in its condition and position for rolling.

The second embodiment of the dinghy of the invention, shown in FIGS. 5 and 6 is very similar in its form to that of FIGS. 1 to 4. However, in this embodiment, the socket means 14 comprises a frusto-conical body 30 secured to the floor 11 and having an axial bore 29 therethrough. Because the bore 29 extends right through the body 30, the height of the body 30 should, of course, be at least equal to the height of the inflatable annulus 10 so as to avoid restricting the possible draught of the dinghy. The handle 22 has, at one end, two diametrically opposed arms 31, 31 each fitted with a respective roller 33, 33 and it will readily be understood that with this arrangement the handle 22 can be inserted into the bore 29 from the underside of the dinghy. Then the rollers 33 retain the handle 22 against unintentional withdrawal from the bore 29, engaging with the rolling on the underside of the floor 11 of the dinghy in register with the inflatable annulus.

When rolling the dinghy, with this arrangement, the handle 22 can be held with the arms 31, 31 horizontal or vertical as may be desired, e.g. according to wind and other forces acting on the dinghy. As a modification, one of the arms 31 may be omitted and replaced by an alternative arm 32, with its respective roller 34, extending at right angles.

The body 30 is preferably made of a lightweight and buoyant material such as expanded polyvinyl chloride, expanded polyurethane, cork or other suitable material. Then, in the event of deflation of the dinghy, the body 30 will float and provide some measure of buoyancy for the user of the dinghy.

Figure 7:
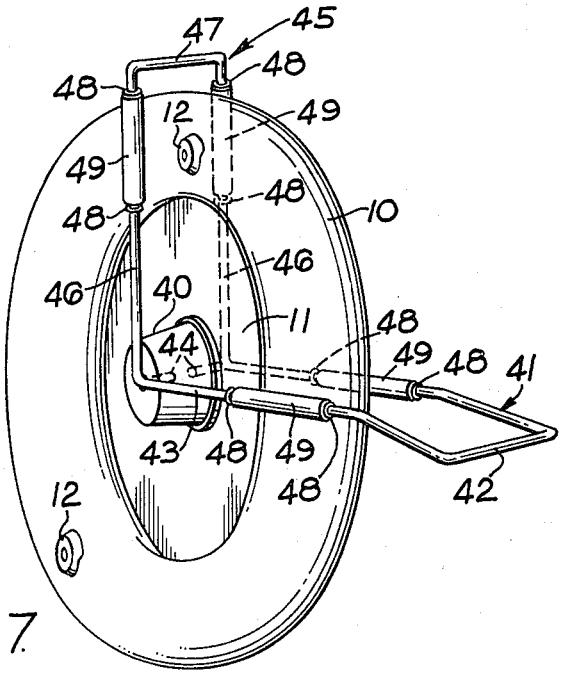
FIG. 7 is a perspective view illustrating a third embodiment of the dinghy in its condition and position for rolling.

FIG. 7 illustrates a third embodiment of the dinghy of the invention. In this instance, a socket arrangement (not visible) under a shroud 40 comprises a socket member similar to the socket member 15 of FIGS. 1 to 4, but with the difference that in this instance the socket member is open both at the top of the shroud 40 and at the underside of the dinghy, and a complementary yoke-like handle 41 is shaped to provide a cross bar 42 connecting together the outer ends of two side-by-side arms 43 the inner ends of which have respective inwardly-directed pivot members or stubs 44 which engage into the socket member 15 from respective opposite sides thereof. An inverted-U-shaped stabilising hoop 45 comprises limbs 46 the inner ends of which connect with the pivot members or stubs 44 and the outer ends of which are connected by a cross-piece 47. Collars 38, on the arms 43 and on the limbs 46, serve to retain thereon respective freely-rotating rollers 49 each being, for example, a loose-fitting plastics sleeve.

The yoke-like handle arrangement 41 enables the dinghy to be rolled as desired under simple manual control and, of course, a receptacle (like the receptacle 26 of the embodiment of FIGS. 1 to 4) can be hung from the handle 41 in the same way as has been shown in FIG. 4. The handle 41 can, of course, be disengaged from the socket arrangement by springing the pivot stub 44 out of the socket member. When the dinghy is being rolled, the rowlocks are removed as shown, and the rollers 49 serve to stabilise the dinghy by providing running surfaces for the sides of the annulus 10.

An arrangement comparable with that of FIG. 7 can, of course, be adapted for connection to a towing hitch of a motor vehicle so that it can be towed behind said vehicle. In this instance a flexible rubbing strake or strakes around the dinghy may serve as a tread for the dinghy to run on the ground or on the road.

The invention is not confined to the precise details of the foregoing examples and variations may be made thereto. For instance, although the invention has been illustrated as applied to dinghies of inflatable construction, it can equally well be applied to craft of rigid or semi-rigid construction. Naturally, the solid buoyant body arrangement of FIG. 5 can be used in the embodiments of FIGS. 1 to 4 and FIG. 6.

Although the illustrated embodiment of dinghy has only a single inflatable annulus, it is possible for the dinghy to have a plurality of inflatable annuli (for example a pair of annuli united to be disposed one above the other). The annuli can be pneumatically separate to minimise the effect of a possible puncture.

I claim:

1. A dinghy comprising: an inflatable tubular annulus and a floor associated with the annulus, the annulus and floor constituting a hull of circular configuration, pivotal means disposed and extending upwardly from substantially centrally of the floor, rolling means engageable with the pivotal means for permitting the hull to be uprighted into a disposition for rolling in wheel-like manner along the outer edge of the annulus, the rolling means enabling the dinghy to be controlled while being so rolled.

2. A dinghy as set forth in claim 1, the pivotal means including a socket member secured to the floor and said rolling means comprising a handle accommodated by the socket.

3. A dinghy as set forth in claim 2, the handle being removable, and a retainer for the handle in the form of a spring-loaded member engageable in a grooving around the handle.

4. A dinghy as set forth in claim 3 wherein the socket member comprises a flat-topped body which additionally serves as a seat.

5. A dinghy as set forth in claim 2, the handle extending through the socket member, and a lateral roller on the handle for preventing withdrawal thereof.

6. A dinghy as set forth in claim 2, the handle comprising a yoke providing a side-by-side pair of arms having respective pivot members engaged in the socket member from opposite sides of the floor.

7. A dinghy as set forth in claim 6, the handle further including a stabilising hoop of generally inverted-U configuration for supporting respective rollers at each side of the dinghy.

8. A dinghy comprising an inflatable tubular annulus and a floor combined with the annulus, the annulus and floor constituting a hull of circular configuration when viewed in plan, pivotal means diposed substantially centrally of the floor, rolling means releasably engageable with the pivotal means to permit the hull to be swung into an upright disposition by which it can be rolled along the outer edge of the annulus after the manner of a wheel, the rolling means enabling the dinghy to be pushed and pulled and controlled while being so rolled.

* * * * *